US008813394B2

(12) United States Patent
Weidman et al.

(10) Patent No.: US 8,813,394 B2
(45) Date of Patent: Aug. 26, 2014

(54) BOWLING SHOE OUTSOLE WITH INTERCHANGEABLE PADS

(75) Inventors: James R. Weidman, Mooresville, NC (US); Daniel E. Norton, El Paso, TX (US)

(73) Assignee: Etonic Holdings, LLC, New York, NY (US)

( * ) Notice: Subject to any disclaimer, the term of this patent is extended or adjusted under 35 U.S.C. 154(b) by 437 days.

(21) Appl. No.: 13/171,511

(22) Filed: Jun. 29, 2011

(65) Prior Publication Data

US 2013/0000153 A1 Jan. 3, 2013

(51) Int. Cl.

| | |
|---|---|
| ***A43B 5/00*** | (2006.01) |
| ***A43B 13/36*** | (2006.01) |
| ***A43B 13/16*** | (2006.01) |
| ***A43B 13/14*** | (2006.01) |
| ***A43B 13/26*** | (2006.01) |

(52) U.S. Cl.

CPC ..... *A43B 5/008* (2013.01); *A43B 13/36* (2013.01); *A43B 13/16* (2013.01); *A43B 13/141* (2013.01); *A43B 13/26* (2013.01)

USPC ..... 36/130; 36/15; 36/100; 36/102

(58) Field of Classification Search

CPC ..... A43B 5/008; A43B 13/36; A43B 13/16; A43B 13/141; A43B 13/26; A43B 13/246

USPC ..... 36/130, 15, 100, 102

See application file for complete search history.

(56) References Cited

U.S. PATENT DOCUMENTS

| | | | | |
|---|---|---|---|---|
| 1,395,958 | A | 11/1921 | Hamilton | |
| 2,061,962 | A | 11/1936 | Gabriele | 36/59 |
| 2,116,956 | A * | 5/1938 | Vorwerk | 36/59 R |
| 2,301,702 | A | 11/1942 | Hite et al. | 36/81 |
| 2,640,283 | A | 6/1953 | McCord | 36/25 |
| 3,011,272 | A | 12/1961 | Goldenberg | 36/2.5 |
| 3,027,661 | A | 4/1962 | McCord | 36/30 |
| 3,031,777 | A | 5/1962 | Leffler | 36/2.5 |
| 3,041,746 | A | 7/1962 | Rakus | 36/36 |
| 3,063,169 | A | 11/1962 | Cortina | 36/36 |
| 3,068,592 | A | 12/1962 | Antelo | 36/36 |
| 3,074,184 | A | 1/1963 | Litak | 36/2.5 |
| 3,156,988 | A | 11/1964 | Rause | 36/81 |
| 3,195,244 | A | 7/1965 | Whitcas | 36/130 |

(Continued)

FOREIGN PATENT DOCUMENTS

| | | | |
|---|---|---|---|
| GB | 2 178 940 | A | 2/1987 |
| GB | 201001306 | A * | 3/2010 |
| GB | 2477285 | A * | 8/2011 |

*Primary Examiner* — Ted Kavanaugh

(74) *Attorney, Agent, or Firm* — Volpe and Koenig, P.C.

(57) ABSTRACT

An elongated perimeter outlining a substantially planar foresole region, a substantially planar heel region, and an arch region recessed from the foresole and heel regions, each of the regions having medial and lateral sides; a heel pad attached to the heel region; a plurality of pockets formed in the foresole region, each pocket having a base and a rigid rim rising from the base above the plane of the foresole region; and a slide pad element in each pocket, having a bottom surface interchangeably secured to the base of the pocket and an outer slide surface, and a peripheral edge which closely conforms to the rim, wherein the conforming edge has a bottom edge portion substantially abutting the rim, and an upper edge portion that protrudes above the rim, whereby the rim is recessed relative to the slide surface.

18 Claims, 9 Drawing Sheets

(56) References Cited

U.S. PATENT DOCUMENTS

| | | | | |
|---|---|---|---|---|
| 3,228,123 | A | 1/1966 | Iams | 36/2.5 |
| 3,318,025 | A | 5/1967 | Antelo | 36/30 |
| 3,377,723 | A | 4/1968 | England | 36/39 |
| 3,478,447 | A | 11/1969 | Gillead | 36/36 |
| 3,672,077 | A | 6/1972 | Coles | 36/134 |
| 3,693,269 | A | 9/1972 | Guarrera | 36/15 |
| 3,875,689 | A | 4/1975 | Frau Tomas | 36/32 R |
| 4,214,384 | A | 7/1980 | Gonzalez | 36/42 |
| 4,267,650 | A | 5/1981 | Bauer | 36/101 |
| 4,279,083 | A | 7/1981 | Dilg | 36/101 |
| 4,301,604 | A | 11/1981 | Hamilton | 36/130 |
| 4,351,120 | A | 9/1982 | Dalebout | 36/117 |
| 4,356,643 | A | 11/1982 | Kester et al. | 36/59 C |
| 4,377,042 | A | 3/1983 | Bauer | 36/101 |
| 4,387,515 | A | 6/1983 | Baldwin | 36/7.5 |
| 4,745,693 | A | 5/1988 | Brown | 36/101 |
| 4,926,568 | A | 5/1990 | Coffman | 36/15 |
| 4,982,737 | A | 1/1991 | Guttmann | 36/140 |
| 5,353,522 | A | 10/1994 | Wagner | 36/15 |
| 5,384,973 | A | 1/1995 | Lyden | 36/25 R |
| 5,410,821 | A | 5/1995 | Hilgendorf | 36/100 |
| 5,446,977 | A | 9/1995 | Nagano et al. | 36/131 |
| 5,542,198 | A | 8/1996 | Famolare | 36/130 |
| 5,727,334 | A | 3/1998 | Cougar | 36/15 |
| 5,862,614 | A | 1/1999 | Koh | 36/31 |
| 5,906,872 | A | 5/1999 | Lyden et al. | 428/52 |
| 5,996,252 | A | 12/1999 | Cougar | 36/15 |
| 6,021,588 | A | 2/2000 | Alviso | 36/102 |
| 6,243,973 | B1 | 6/2001 | Lind | 36/130 |
| 6,289,611 | B1 | 9/2001 | Patterson et al. | 36/127 |
| 6,389,712 | B1 * | 5/2002 | Schelling | 36/15 |
| 6,405,459 | B1 | 6/2002 | Prevost et al. | 36/130 |
| 6,598,324 | B1 | 7/2003 | Tsuji | 36/130 |
| 6,651,360 | B1 | 11/2003 | Lind | 36/130 |
| 6,662,475 | B2 | 12/2003 | Lewis | 36/130 |
| 6,662,476 | B1 | 12/2003 | Lind | 36/130 |
| 6,748,675 | B2 | 6/2004 | Sato | 36/30 R |
| 6,802,139 | B2 | 10/2004 | Pitts et al. | 36/51 |
| 6,907,682 | B2 | 6/2005 | Alfond et al. | 36/130 |
| 7,152,340 | B2 | 12/2006 | Issler | 36/15 |
| D544,182 | S | 6/2007 | McClaskie | D2/952 |
| D547,533 | S | 7/2007 | McClaskie | D2/959 |
| 7,246,453 | B2 | 7/2007 | Kim | 36/15 |
| D552,333 | S | 10/2007 | McClaskie | D2/953 |
| D554,838 | S | 11/2007 | McClaskie | D2/957 |
| D554,841 | S | 11/2007 | McClaskie | D2/960 |
| D580,139 | S | 11/2008 | McClaskie | D2/953 |
| 7,543,399 | B2 | 6/2009 | Kilgore et al. | 36/101 |
| 7,654,015 | B2 | 2/2010 | Nakayama | 36/130 |
| 7,814,682 | B2 * | 10/2010 | Grove et al. | 36/15 |
| 7,895,773 | B2 | 3/2011 | Robinson et al. | 36/127 |
| 2001/0054242 | A1 | 12/2001 | Miller, II | 36/127 |
| 2002/0004996 | A1 | 1/2002 | Scheucher | 36/62 |
| 2002/0032974 | A1 | 3/2002 | McCrindle | 36/130 |
| 2003/0159314 | A1 | 8/2003 | Lewia | 36/130 |
| 2004/0111925 | A1 | 6/2004 | Fukui | 36/142 |
| 2005/0246923 | A1 * | 11/2005 | Bergamin | 36/131 |
| 2006/0130364 | A1 | 6/2006 | Greene et al. | 36/28 |
| 2007/0107260 | A1 | 5/2007 | Pasternak | 36/39 |
| 2007/0107268 | A1 | 5/2007 | Seeman et al. | 36/130 |
| 2007/0199213 | A1 | 8/2007 | Campbell et al. | 36/102 |
| 2008/0196274 | A1 * | 8/2008 | Gerber | 36/100 |
| 2010/0083539 | A1 | 4/2010 | Norton | 36/127 |
| 2010/0122473 | A1 | 5/2010 | Santos | 36/100 |

* cited by examiner

BOWLING SHOE OUTSOLE WITH INTERCHANGEABLE PADS

BACKGROUND

The present invention relates to athletic shoes, and particularly to outsoles for bowling shoes.

In many sports or athletic games, the player wears specialized shoes having a construction, especially an outsole, which is adapted to support the player in the particular movement characteristic of that sport or game. For bowling, the slide and braking characteristics of the shoe are important, especially for professionals and serious amateurs. Various techniques and outsole configurations have been proposed for enabling the bowler to personalize these characteristics.

Some of these techniques involve interchangeable slide pads on the foresole, with or without interchangeable heel pads. Each pad has a different surface characteristic, whereby the frictional interaction between shoe and lane can be altered to suit the individual bowler's style and idiosyncrasies. Most of these techniques rely on a hook and loop engagement between the pads and the tread.

One problem presented by interchangeable slide pads connected to the foresole tread by hook and loop fabric, has been the tendency of the front edge of the slide pad to begin peeling away, especially for bowlers who exhibit a relatively steep toe angle of attack on the lane. Another has been optimizing the tradeoff between providing sufficient total contact area between the pad and the lane, which some believe requires complete coverage of the pad over the foresole tread, while permitting different coefficients of friction under different regions of the tread.

SUMMARY

The present invention not only greatly reduces the risk of slide pad peeling, but also provides the additional advantages of increased options for optimizing slide pad interaction with the lane, and greater responsiveness of the shoe to the natural flexing of the foot.

The bowling outsole according to the present disclosure has a plurality of rimmed pockets separated by flex grooves, with a distinct interchangeable slide pad element in each pocket.

Preferably at least three distinct pockets are defined by rims which protrude below the hook and pile layers and extend to the partial thickness of the slide pad elements, thereby providing fixed lateral boundaries for the slide pads.

The base of each pocket and the upper side of each slide pad element can be interengaged by hook and loop fabric, for easy manual replacement of one or more slide pad elements.

When combined with an interchangeable heel pad, preferably also attachable via hook and loop, the overall combination of a bowling shoe having the novel outsole with multiple interchangeable slide pad elements and heel pads, achieves a high degree of personal adjustability for the frictional interaction with the lane.

A specially located longitudinal groove can optionally be provided to improve stability and comfort. As viewed looking downwardly at the exterior surface of the outsole, the longitudinal groove can extend in the foresole from near the toe to near the arch, and two spaced apart cross grooves can extend between lateral and medial edges of the foresole.

A normal foot has a heel, a medial arch, a lateral arch, two medial phalanges (#1 and #2), a center phalange (#3), and two lateral phalanges (#4 and #5). The outsole comprises a substantially planar outer foresole region, a substantially planar outer heel region, and an outer arch region recessed from the foresole and heel regions, each of these regions having medial and lateral sides. A plurality of lateral and medial pockets are spaced apart longitudinally adjacent the perimeter on each of the lateral and medial sides of the outer foresole region, respectively. Slide pad elements attached in the pockets project from the plane of the foresole region. The optional flex groove runs longitudinally through the outer foresole region between medial and lateral pockets, in a substantially vertical registry with a region of the foot defined by the center phalange (#3) and the medial and lateral phalanges (#2 and #4) adjacent the center phalange.

The longitudinal groove is in substantially vertical registry with a region of the foot defined between the medial phalange (#2) and the closer lateral phalange (#4), from the toes to the lateral arch of the foot. Preferably, the groove is in substantially vertical registry with a region of the foot defined by the center phalange (#3) and the #4 lateral phalange, from the toes to the arch of the foot.

Ideally, the foresole of the bowler's front (slide) shoe contacts the lane approach at a flat, shallow angle to horizontal (less than 25 deg.), thus nearly parallel to the lane. If the bowler has an unconventional approach whereby the foot is angled to the left or right, an undesirable lever action is initially produced. The natural bend line of the foot associated with such angulation extends longitudinally from the junction of the medial and lateral arch, forwardly between the medial phalange (#2) and the closer lateral phalange (#4). A corresponding longitudinal groove in the outsole reduces the lever angle effect and promotes a substantially flatter contact with the approach.

In a further preference, another, transverse groove extends between the lateral and medial sides of the outer foresole region, having an inverted "V" shape with the apex of the "V" directed forwardly and intersecting the longitudinal groove. The transverse groove should ideally lie in substantially vertical registry with all of the five phalange joints that lie midway between the toes and the arches of the foot, at the natural flex points of the foot (i.e., the metatarsal heads).

This V groove provides improved front/back flexure, in a synergistic combination with the lateral bend line provided by the longitudinal groove.

BRIEF DESCRIPTION OF THE DRAWING

Various embodiments will be described in greater detail below with reference to the accompanying drawing, in which.

DETAILED DESCRIPTION

Figure 1:
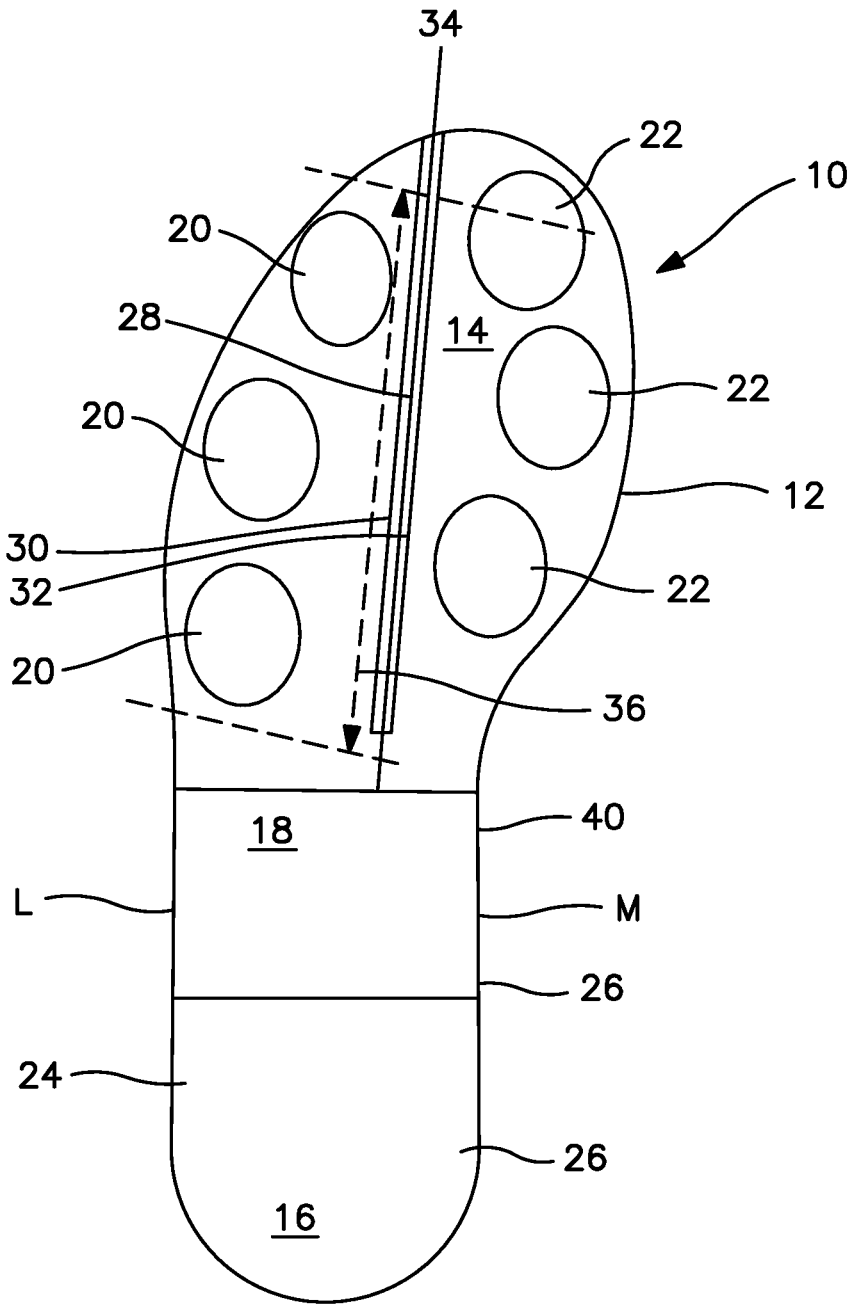
FIG. 1 is a schematic of the outsole of a bowling shoe for the right foot, showing a plurality of distinct slide pad elements on the foresole according to one aspect of the invention.

FIG. 1 shows an outsole 10 having an elongated perimeter 12 corresponding to the shape of a right foot of given size, outlining a substantially planar foresole region 14, a substantially planar heel region 16, and an arch region 18 recessed from the foresole and heel regions, each of the regions having forward and rearward ends (toe to arch) and medial M and lateral L sides. A plurality of lateral 20 and medial 22 slide pad elements are spaced apart longitudinally adjacent the perimeter on each of the lateral and medial sides of the foresole region, respectively, and project above the plane of the foresole region. A heel pad 24 projects above the plane of the heel region. A first groove 28 runs longitudinally through the foresole region 14 between all of the medial and lateral pad elements 20, 22.

In FIG. 1, the groove 28 is defined by sidewalls 30, 32, which are shown as straight but which may provide a continuous convex curvature between the pads 20, 22 of the foresole region 14, as viewed from the medial pads. The groove 28 preferably has a front end at a longitudinally front point of the foresole region. In essence, a straight line 34 can be extended within the sidewalls 30, 32, between all of the medial and lateral pads in the foresole region. This span is indicated by the dashed line 36. The groove 28, and in particular the straight line 34, lies about midway between or preferably closer to the lateral side L of the foresole region 14, relative to the medial side M of the foresole region.

Figure 2:
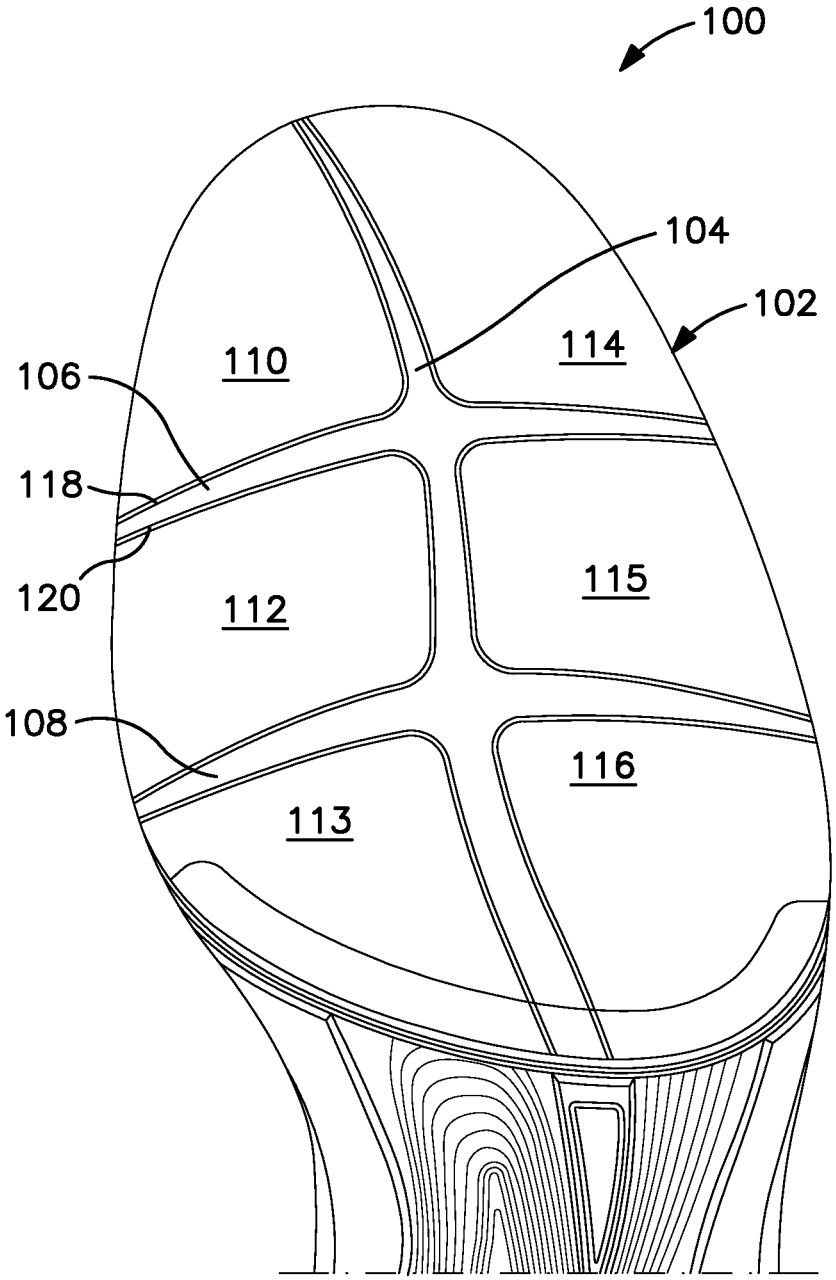
FIG. 2 is a schematic of the foresole region of the outsole of a bowling shoe for the left foot, showing a plurality of pockets for receiving respective slide pad elements, with a longitudinal flex groove and cross grooves.

In FIG. 2, the outsole 100 has a foresole region 102 having a longitudinal groove 104 that is similar to the groove 28 of FIG. 1, except that two cross grooves 106, 108 are provided. Each resembles a broad "V", with the apex intersecting the longitudinal groove 104, and with the apex of each pointing forward. The outsole has a slightly "S" shaped longitudinal groove.

Figure 3:
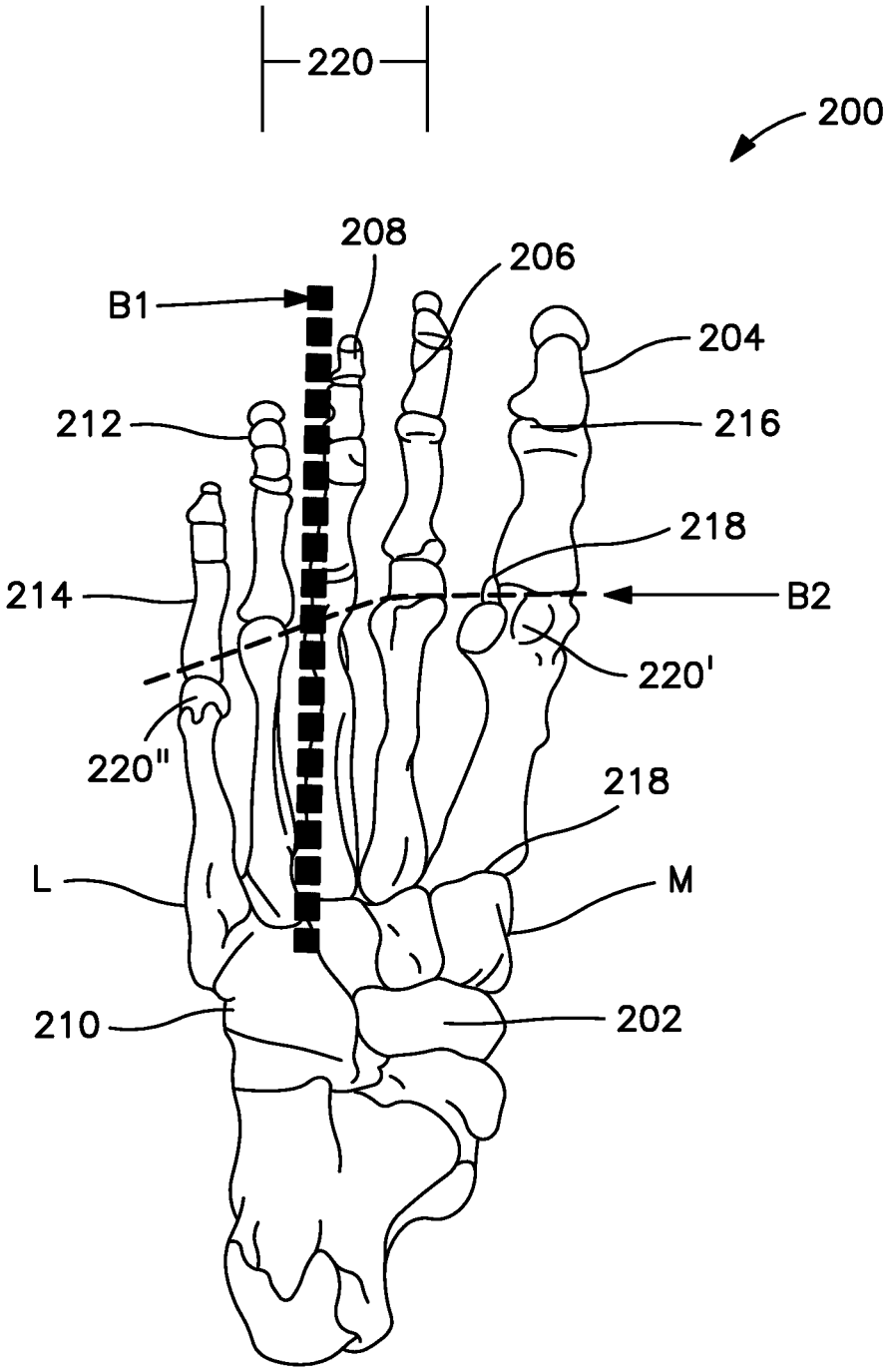
FIG. 3 shows the anatomical features of the human right foot in relation to the bend lines during movement with respect to FIG. 1.

In FIG. 3, the medial M and lateral L sides of the foot 200 are evident, along with the medial arch 202, medial phalanges (#1 and #2), the center phalange (#3) 208, the lateral arch and lateral phalanges (#4 and #5). The phalanges extend from toes such as 216 rearward to the junction 218 with the respective arch bones. Line B1 indicates the anatomical bend line of the foot when the person moves from side to side (lateral bend line) and line B2 indicates the anatomical bend line of the foot when a person moves forward, such as in walking.

According to one feature of the present disclosure, the longitudinal groove 28, 104 as shown in FIGS. 1 and 2 runs through the outer foresole region between medial and lateral pockets, in substantially vertical registry with a region of the foot defined by the center phalange 208 and the lateral and medial phalanges 212 and 206 adjacent the center phalange from the toes to the arch of the foot. This region is indicated by 220 in FIG. 3.

Preferably, the groove such as 28, 104 is in substantially vertical registry with a region of the foot defined by the center phalange 208 and the adjacent lateral phalange 212, i.e., substantially vertically aligned with the anatomical bend line B1.

Transverse groove 108 extends between the lateral and medial sides of the outer foresole region. The transverse groove should ideally lie in substantially vertical registry with all of the five phalange joints such as 220', 220" lying midway between the toes 216 and the intersection 218 with the arch. This groove provides improved front/back flexure, in a synergistic combination with the lateral bend line provided by the longitudinal groove.

In the main aspect of the present invention, a plurality of pockets 110-116, are formed in the foresole region 102, each pocket having a base and a rigid rim rising above the plane of the foresole region. In FIG. 2, rim 118 is associated with pocket 110, and rim 120 is associated with pocket 112. The rim need not circumscribe the entire pocket, but should define at least 50% of the boundary of the pocket.

Figure 4:
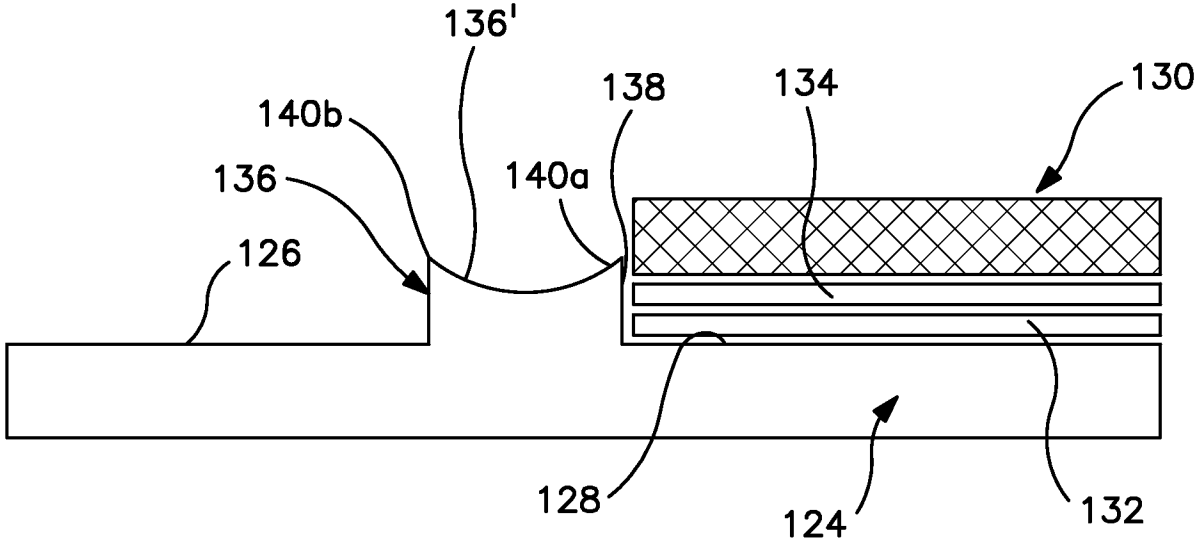
FIG. 4 is a section view of a portion of a pocket, surrounding a slide pad element.

FIG. 4 is a schematic representation of the interface among the base of the pocket, the rim, and the slide pad element. The main, preferably rubber outsole tread 124 defines a substantially planar surface 126 which in the illustrated embodiment defines the base 128 of a pocket. The slide pad element 130 is interchangeably secured to the base of the pocket, preferably by means of a first hook and/or loop member 132 adhered to the base 128 of the pocket and a second hook and loop member 134 secured to the bottom of the slide pad element. Because the slide pad 130 is substantially congruent with the base of the pocket, the side wall 138 of the rim 136 is in substantially abutting relationship with the edge of slide pad element 130. The side wall terminates or peaks at **140*a*. The lower (inner) portion of the body of the slide pad element 130 is below the upper edge 140*a*** of the rim, i.e., the slide pad element has a lower portion closely abutting the rim and an upper (outer) portion protruding above the rim.

In FIG. 4, rim 136 forms a concave surface that defines spaced apart sidewalls with respective peaks **140*a*, 140*b*, with a shallow groove 136' between them. In this embodiment, peaks 140*a* and 140*b* with intervening groove 136' correspond to rims 118 and 120 with intervening groove 118 shown in FIG. 2**. Accordingly, a unitary structure between two distinct bases can form a respective two rims for a respective two pockets.

With reference again to FIG. 2, six pockets for accommodating a respective six slide elements are shown. The shoe would be sold with a slide pad collection, in which for each pocket at least two slide pad elements having different coefficients of friction would be provided for interchangeable attachment in the pockets. Importantly, even if each of two sets has the same material, many overall combinations of effective sliding friction can be achieved by mixing, pocket-by-pocket, the slide pad elements. Moreover, each slide pad element made from the same material can have the same color for ease of identification. If, for example, three sets of slide pads were purchased, it is possible that pads having three different colors could be distributed among the six pockets.

As is known in the art, the outer surface of the slide pad for contacting the approach to the bowling lane, can be made of buckskin, rubber of varying hardnesses such as 60, 80, or 95 durometer, leather, or the like.

Figure 5:
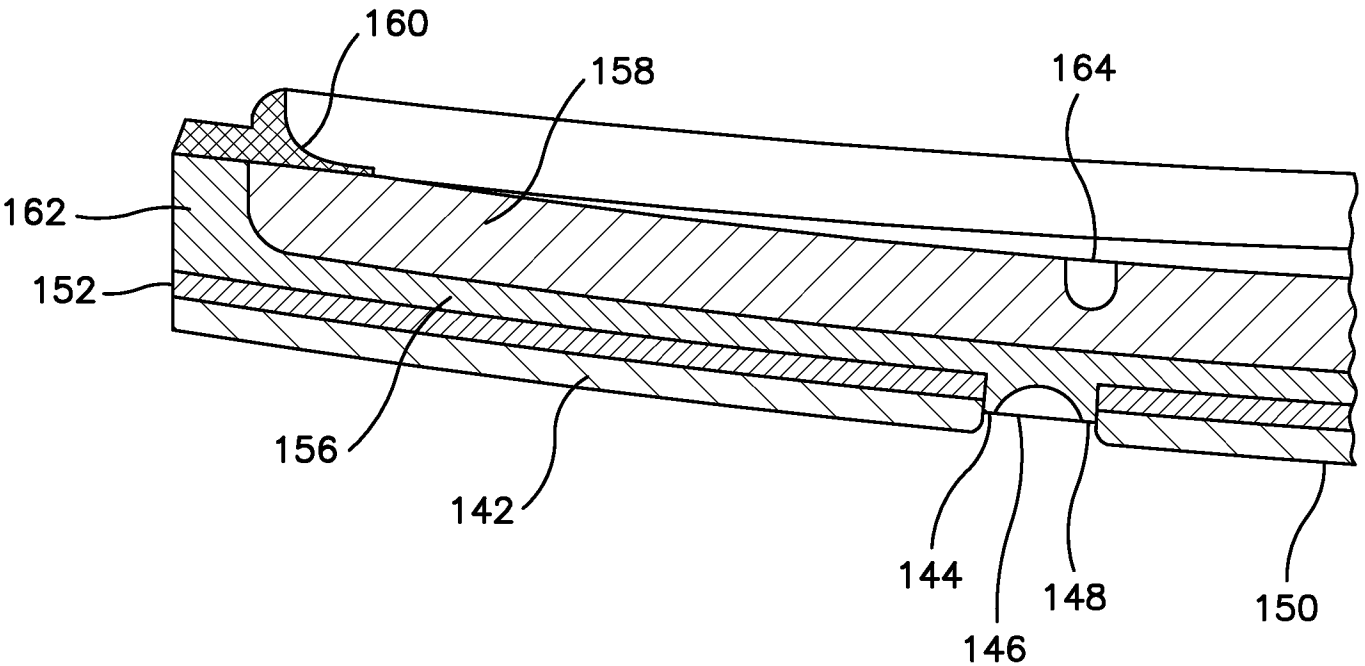
FIG. 5 is a longitudinal section view through the center of the toe area of the outsole depicted in FIG. 2.

In FIG. 5, the toe portion of the foresole of FIG. 2 is shown in longitudinal section, but different numeric identifiers are used for clarity. A slide pad 142 defines the bottom surface, and extends rearwardly from the toe back to the rim 144, which in turn has cross-groove 146, on the other side of which another rim 148 is defined to abut another slide element 150. The material indicated at 152 is inter-engaged hook and loop material one side of which is attached to the slide pad 142 and the other side of which is attached to the rubber material 156 at the base of the pocket. An EVA layer 158 overlies the rubber layer 156. A TPU nose 160 is provided, overlaying the front of the EVA layer 158 and an enlarged portion 162 of the rubber layer 156. If one considers the bottom of the rubber layer 156 as defining the foresole tread, such tread has a gentle curvature, conventionally known as "toe spring" that is substantially continuous, without any angulation forming a wedge or the like. The slide pad element 142 and hook and loop material 152 follow this continuous curvature.

Notwithstanding the absence of a rim at the toe and side edges of the front foresole portion of the outsole, there is little danger that the slide pad will separate from the tread 156, even if the bowler steps on the approach at a severe angle, because the slide pad 142, hook and loop attachment (Velcro) 152 and tread 156 flex together without giving rise to differential strain. This is a consequence of the relatively small area occupied by each slide pad element as compared with the entire foresole, and the presence of the cross-grooves 106 and 108 (FIG. 2).

Additional internal cross-grooves 164 can be provided in the foot bed of the EVA layer, to improve wearer comfort.

Figure 6:
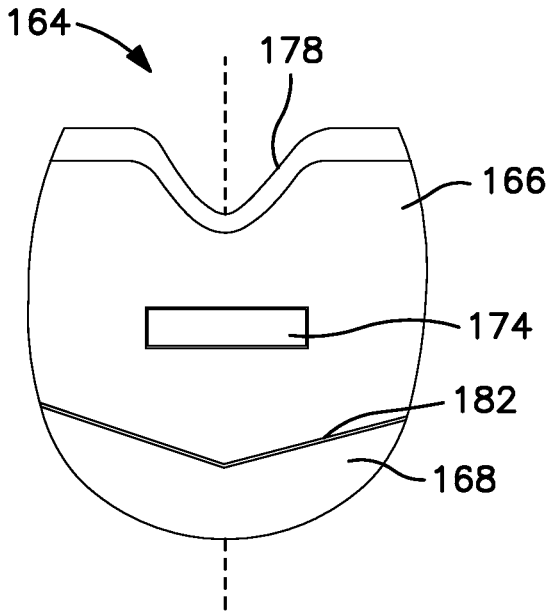
FIGS. 6 and 7 show planar and section views of the preferred heel pad.

FIG. 6 shows a preferred, interchangeable heel pad 164 having a relatively larger, interchangeable forward region 166 exhibiting a first coefficient of friction and a fixed, rearward region 168 exhibiting a second coefficient of friction. For example, the rear region 168 can have a hardness of 60 durometer, with the front region being replaceable with varying hardness, for example, of 60, 80, and 95 durometer, rubber, buckskin, or leather, etc. Moreover, the forward region can itself define two different regions. Accordingly, the heel can have a pattern of differing coefficients of friction.

Figure 7:
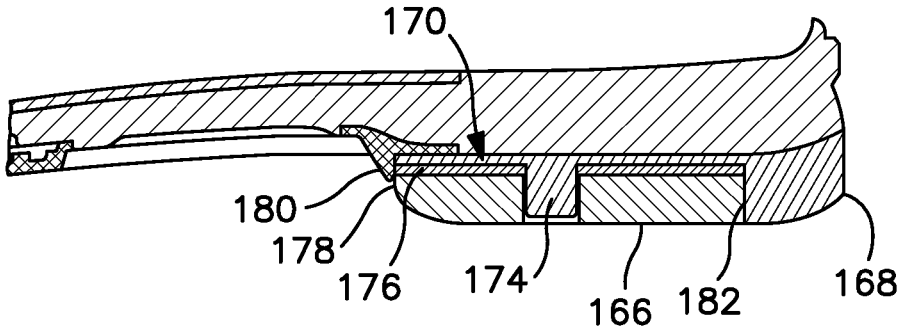

As also shown in FIG. 7, the base 170 of the heel and the rear portion 168 are a permanent part of the shoe, and can be a unitary component. This permanent part defines a recess penetrated by a downward projection 174 shown as rectangular in FIGS. 6 and 7. The replaceable portion 166 of the heel fits in the recess, and includes an attached hook and/or loops surface 176, which is mateable with a hook and/or loop surface attached to the base 170 of the heel.

The replaceable portion 166 can readily be removed with the thumb or finger placed near the forward edge 178 which abuts stop 180 and pulled downwardly, thereby opening the recess into which a variety of interchangeable friction surfaces can be inserted. The hook and loop provides sufficient attachment between the replaceable pad 166 and the base, but as a further precaution, the projection 174 serves as lock and the front edge 182 of the fixed rear portion 168 of the heel provides further resistance to movement of the heel as it touches down on the approach while sliding and breaking.

Figure 8:
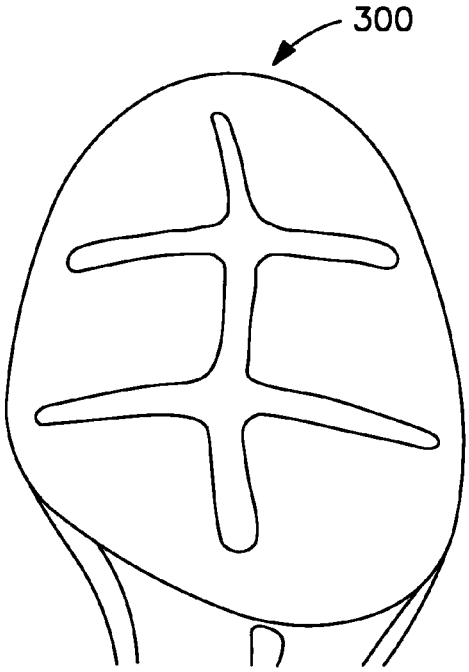
FIGS. 8-11 show possible variations of the slide pad element configurations on the foresole.
Figure 9:
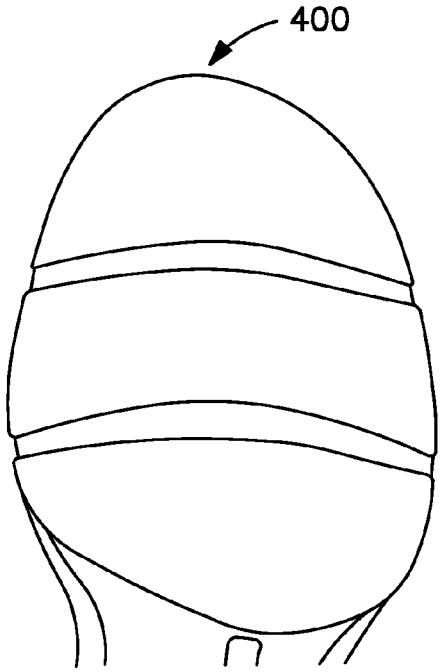
Figure 10:
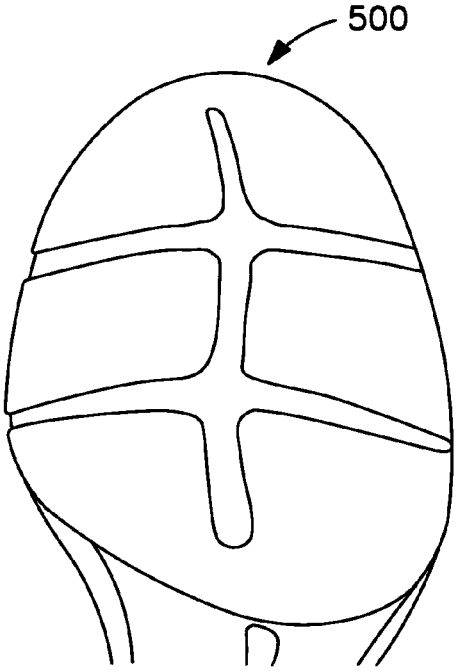
Figure 11:
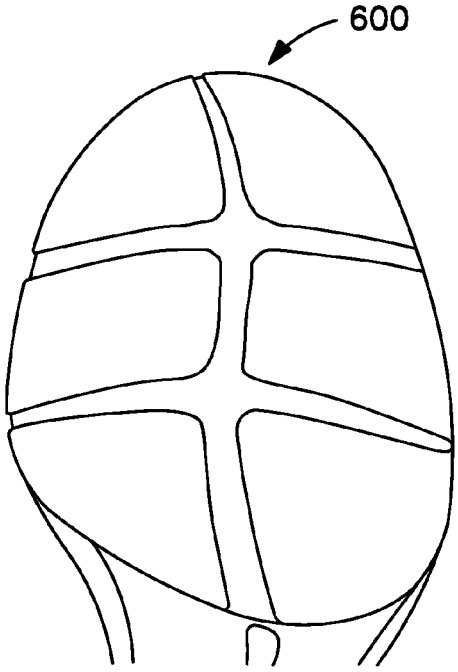

Other embodiments 300, 400, 500 and 600 are shown in FIGS. 8-11 with the observer viewing the slide pads. In FIGS. 1, 2, 9, and 11 a plurality of individual slide pad elements are provided in respective individual pockets. In FIG. 8, a single slide pad has various regions, each of which can be considered as retained in a respective pocket. FIG. 10 shows a combination wherein the front most and rear most slide pads each have two regions that occupy respective two pockets, whereas each of the two intermediate slide pads are independent. All embodiments have cross grooves, which as noted above, play a significant role in avoiding separation of the slide elements from the tread.

Figure 13:
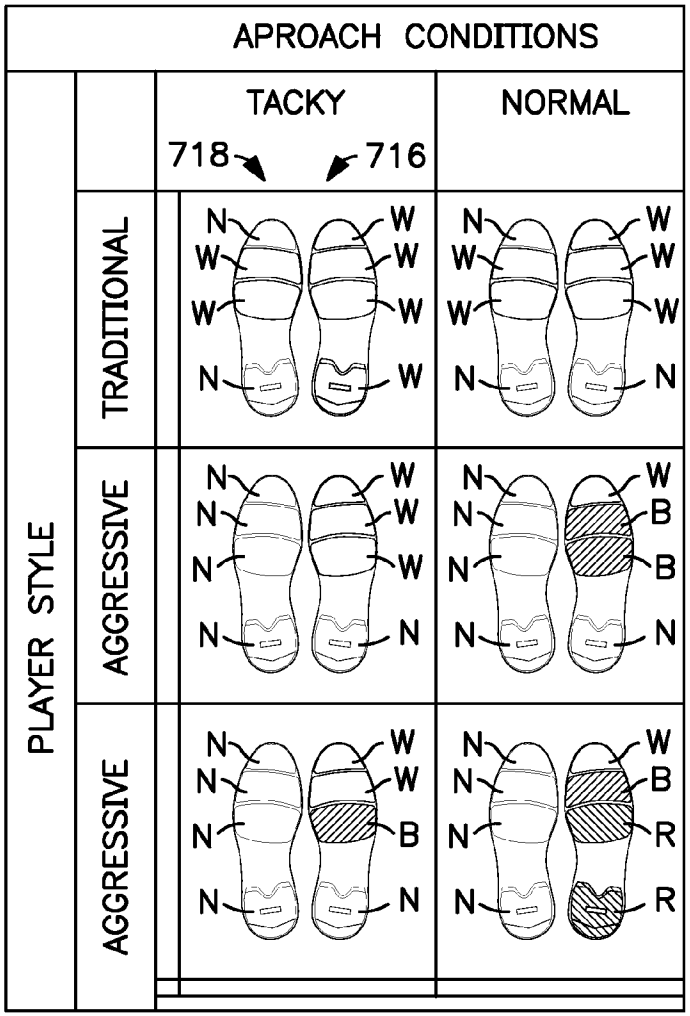
FIG. 13 shows some of the combinations of slide pads and interchangeable heels for left and right bowling shoes associated with FIG. 12.
Figure 12:
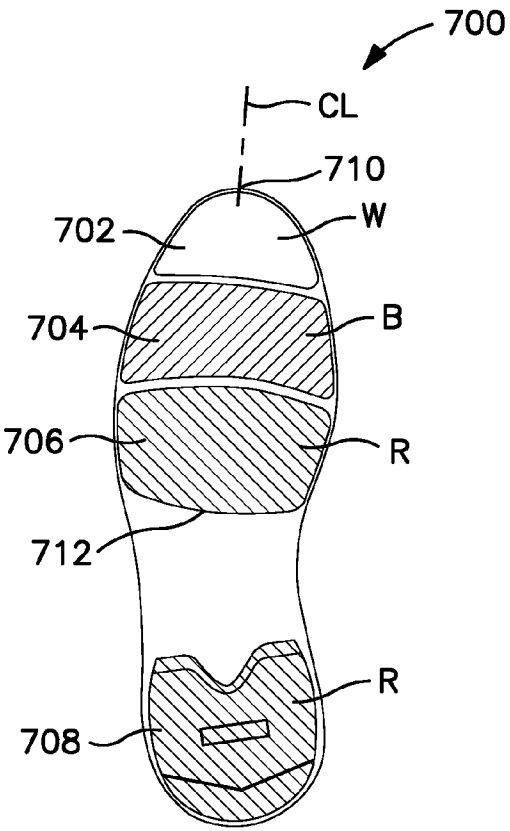
FIG. 12 shows the outsole of a bowling shoe for the right foot, with a variation of the foresole slide pads shown in FIG. 9 and the interchangeable heel shown in FIG. 6.
Figure 14:
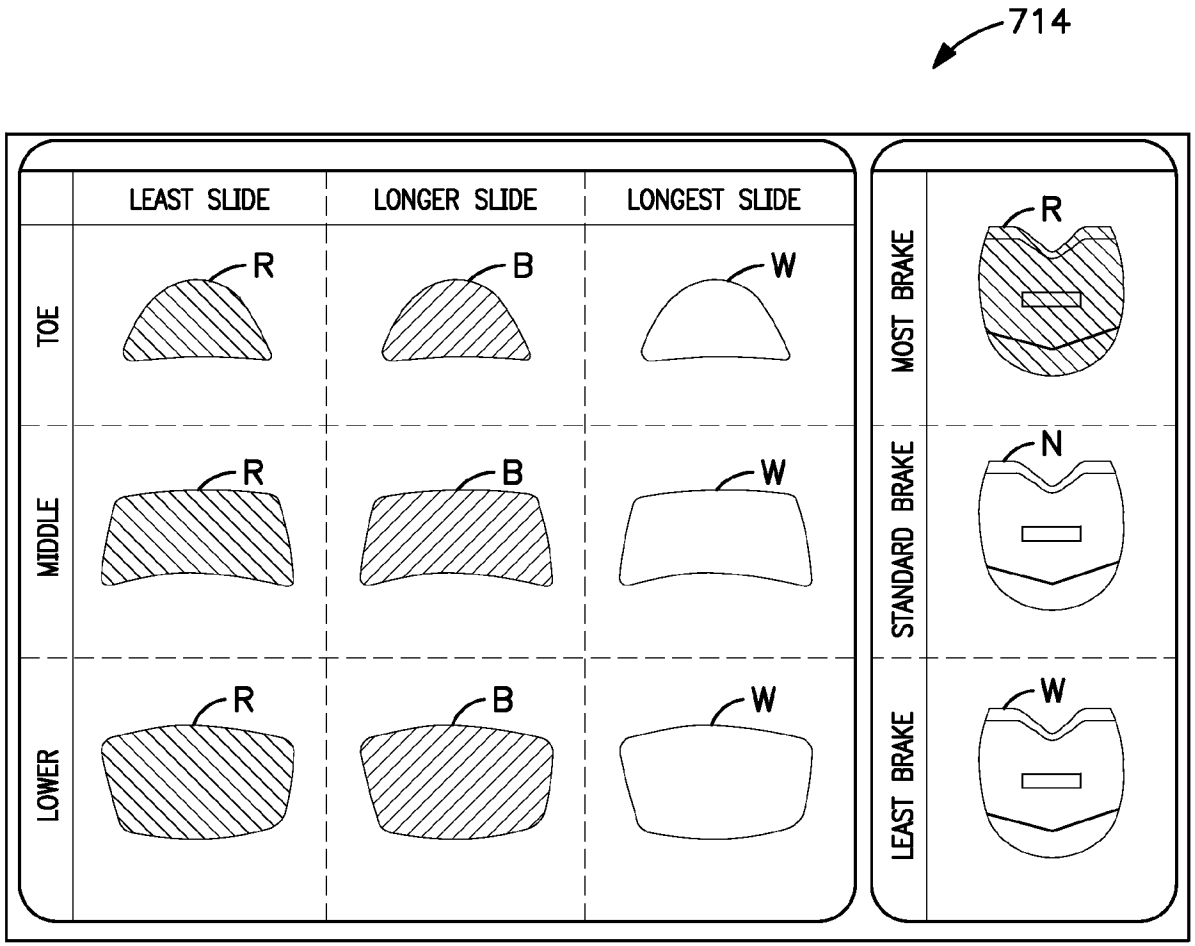
FIG. 14 shows one embodiment of a kit containing a variety of symmetric pads of differing coefficients of friction.

FIGS. 12-14 show a further preference associated with the foresole slide pad configuration of FIG. 9. FIG. 12 shows the bottom of a bowling shoe 700 for the right foot in which three slide pads 702, 704, 706 are attached to pockets in the foresole and the heel pad 708 is configured as described with respect to FIGS. 6 and 7. As both a manufacturing simplification and user convenience, each of the slide pads in the foresole is mirror symmetric about a longitudinal center line CL passing from the toe 710 to the arch 712. Since the bottom of the shoe for the left foot has similarly shaped pockets, the front pad 702 for one shoe can be used in the other shoe, the intermediate pad 704 from one shoe can be used in the other shoe, and the rear pad 706 of one shoe can be used in the other shoe FIGS. 13 and 14 depict how the content of a kit 714 can be used in combination with a pair of left and right bowling shoes 716, 718 based on the symmetric pockets of FIG. 12, and the replaceable heel. In the slide pad array of the kit 714, each of the toe, middle, and lower slide pads is provided in, for example, a red R, brown B, and white W version. The red version provides the least slide (highest coefficient of friction), the brown version provides a longer slide, and the white version provides the longest slide. Similarly, for the heel pad, three color coded versions can be provided, such as red R for most brake, black/gray (N) for standard or neutral brake, and white W for least brake.

FIG. 13 illustrates a representative set of sole and heel configurations that can be implemented. It should be understood that each of the left and right shoes can be purchased with all the foresole pockets and the heel recess containing a standard material, such as rubber, composed to provide the typical slide and brake characteristics of a conventional bowling shoe (herein, indicated by N for neutral). The top row represents the weight shift and sliding characteristics of a traditional bowler. For play on a tacky lane, such player would likely configure with the right shoe (appearing on the left) having the standard toe pad, but with the middle and lower slide pads replaced by the white pads from the kit. The left shoe (on the right) would have all pockets filled with white slide pads, and the heel recess filled with the white pad as well. However, as shown in the right column, the player having the same style delivery on a normal lane, might use the same configuration on the right shoe, and the same foresole configuration on the left shoe, but replace the white heel pad with a neutral pad, for standard braking. The subsequent rows show possible configurations of the left and right shoes for a player having a more vigorous power stroke when bowling on tacky or normal lanes, and the configuration for a very aggressive bowler on tacky or normal lanes.

The invention claimed is:

1. An outsole for a bowling shoe comprising:

an elongated perimeter outlining a substantially planar foresole region, a substantially planar heel region, and an arch region recessed from the foresole and heel regions, each of said regions having medial and lateral sides;

a heel pad attached to said heel region;

a plurality of pockets formed in the foresole region, each pocket having a base and a rigid rim rising from the base above the plane of the foresole region; and a slide pad element in each pocket, having a bottom surface interchangeably secured to the base of the pocket and an outer slide surface, and a peripheral edge which closely conforms to said rim, wherein the conforming edge has a bottom edge portion substantially abutting said rim, and an upper edge portion that protrudes above said rim, whereby the rim is recessed relative to the slide surface and wherein at least two of the slide pad elements in the pockets are constituted by different materials having respective different coefficients of friction.

2. The outsole of claim 1, wherein a perimeter for each slide pad element is defined by a continuous peripheral edge of the slide pad.

3. The outsole of claim 1, wherein a lateral pocket and a medial pocket are spaced apart longitudinally adjacent the perimeter on each of the lateral and medial sides of the foresole region, respectively;

a first groove runs longitudinally through the foresole region between all of the medial and lateral pockets; and a second groove extends transversely between the lateral and medial sides of the foresole region, having an inverted "V" shape with the apex of the "V" directed forwardly and intersecting the first groove.

4. The outsole of claim 1, wherein the heel is interchangeable.

5. The outsole of claim 3, comprising at least two lateral pockets and at least two medial pockets.

6. A bowling shoe having the outsole of claim 1, in combination with a collection of slide pad elements in which at least two pad elements having different coefficients of friction are provided for interchangeability in each pocket.

7. The combination of claim 6, wherein each pocket has a unique shape, at least two pad elements of corresponding shape are provided for each pocket, and each of the two corresponding pads is made of a different material.

8. The combination of claim 7, wherein every pad made of the same material has the same color that is different from the color of the pad made from a different material.

9. The outsole of claim 3, wherein the first groove is defined by sidewalls and an uninterrupted straight line can be extended within the sidewalls between all of the medial and lateral pockets in the foresole region.

10. The outsole of claim 9, wherein the first groove lies midway between or closer to the lateral side of the foresole region, relative to the medial side of the foresole region.

11. The outsole of claim 3, as part of a bowling shoe, said shoe having a perimeter outlining a wearer's foot of given size, wherein said foot includes a heel, a lateral arch, a medial arch, two lateral phalanges, a center phalange, and two medial phalanges, and wherein said first groove runs longitudinally through the outer foresole region between medial and lateral pockets, in substantially vertical registry with a region of the foot defined by the center phalange and the lateral and medial phalanges adjacent the center phalange.

12. The outsole of claim 11, wherein the groove extends from the toes to the arches of the rear most part of the phalanges.

13. The outsole of claim 11, wherein the groove is in substantially vertical registry with a region of the foot defined by the center phalange and the lateral phalange adjacent the center phalange.

14. The outsole of claim 11, wherein the groove is in substantially vertical registry with the center phalange from the toes to the arches of the rear most part of the phalanges.

15. The outsole of claim 11, wherein the second groove lies in substantially vertical registry with all of the five phalange joints lying midway between the toes and the arches of the foot.

16. A combination comprising a bowling shoe having an outsole, said outsole comprising:

an elongated perimeter outlining a foresole region, a heel region, and an arch region between the foresole and heel regions, each of said regions having forward and rearward ends and medial and lateral sides;

a heel pad attached to said heel region;

a plurality of pockets formed in the foresole region, each pocket having a base with forward and rearward ends and medial and lateral sides, a base attachment surface, and rigid rims projecting from at least the forward and rearward ends of the base;

a slide pad element in and substantially congruent with each pocket, having a selectively detachable and attachable inner surface secured to the base attachment surface and an outer surface protruding from the rim;

wherein the foresole has three pockets, each extending from the lateral to medial side of the foresole region, a first of said pockets is situated at the forward end of the foresole region, a second of said pockets is situated rearward of the first pocket and separated from the first pocket by a rim running from the lateral to the medial side of the foresole, and a third of said pockets is situated rearward of the second pocket and separated from the second pocket by a different rim running from the lateral to the medial side of the foresole;

wherein each of the first, second and third pockets and each of respective first, second and third slide pads is symmetric with respect to a longitudinal center line running from the forward to the rearward end of the foresole region;

wherein the heel pad has an exterior surface having a non-uniform coefficient of friction and an interior surface that is selectively attachable and detachable from the heel region; and the bowling shoe, in combination with another bowling shoe which together constitute a pair, and a kit of slide pads and heel pads, wherein the kit includes at least three of the first slide pads, each having a different coefficient of friction;

at least three of the second slide pads, each having a different coefficient of friction;

at least three of the third slide pads, each having a different coefficient of friction; and at least three heel pads, each having a different exterior surface and associated non-uniform coefficient of friction.

17. The bowling shoe of claim 16, wherein the second pocket is separated from the first pocket by a groove rim running from the lateral to the medial side of the foresole; and the third pocket is separated from the second pocket by a groove rim running from the lateral to the medial side of the foresole.

18. The outsole of claim 17, wherein a perimeter for each slide pad element is defined by a continuous and closed peripheral edge of the slide pad.

* * * * *